US006901770B2

(12) United States Patent
Scaringe et al.

(10) Patent No.: US 6,901,770 B2
(45) Date of Patent: Jun. 7, 2005

(54) REMOVABLE FILTER DRYER WITH CAPACITY INDICATOR FOR VAPOR COMPRESSION SYSTEMS

(75) Inventors: Robert Scaringe, Rockledge, FL (US); Todd Gibson, Rockledge, FL (US)

(73) Assignee: Mainstream Engineering Corporation, Rockledge, FL (US)

( * ) Notice: Subject to any disclaimer, the term of this patent is extended or adjusted under 35 U.S.C. 154(b) by 195 days.

(21) Appl. No.: 10/214,388

(22) Filed: Aug. 8, 2002

(65) Prior Publication Data

US 2004/0025532 A1 Feb. 12, 2004

(51) Int. Cl.[7] ..... F25B 43/00

(52) U.S. Cl. ..... 62/474; 62/475; 62/512; 62/129

(58) Field of Search ..... 62/474, 475, 129, 62/512

(56) References Cited

U.S. PATENT DOCUMENTS 3,785,164 A * 1/1974 Wrenn, Jr. ..... 62/129
4,170,998 A * 10/1979 Sauder ..... 128/400
4,554,792 A * 11/1985 Margulefsky et al. ..... 62/77
4,611,750 A * 9/1986 Kish ..... 228/184
4,730,465 A * 3/1988 Inoue ..... 62/503
4,788,833 A * 12/1988 Steele ..... 62/474
5,186,017 A * 2/1993 Hancock et al. ..... 62/292
5,247,802 A * 9/1993 Maniez et al. ..... 62/77
5,334,309 A * 8/1994 Huggett et al. ..... 210/133
5,544,494 A * 8/1996 Manz et al. ..... 62/292
5,645,720 A * 7/1997 Godines ..... 210/282
5,813,249 A * 9/1998 Matsuo et al. ..... 62/509
5,943,867 A * 8/1999 Thomas et al. ..... 62/85
6,244,055 B1 * 6/2001 Hanson et al. ..... 62/85

FOREIGN PATENT DOCUMENTS

JP 2001074341 A * 3/2001

* cited by examiner

*Primary Examiner*—William C. Doerrler
(74) *Attorney, Agent, or Firm*—Crowell & Moring LLP

(57) ABSTRACT

A refrigerant filter/dryer assembly isolates, removes, and replaces a filter/dryer core, and allows the vapor-compression heat pump system to continue to operate while the filter/dryer is being replaced. The refrigerant flow is automatically by-passed and the filter/dryer core is isolated for removal. The filter/dryer easily connects back into the refrigerant flow path. An indicator can be provided for indicating the remaining useful life of the filter/dryer while it is being used in the system.

38 Claims, 14 Drawing Sheets

REMOVABLE FILTER DRYER WITH CAPACITY INDICATOR FOR VAPOR COMPRESSION SYSTEMS

BACKGROUND OF THE INVENTION

The present invention relates to a simple, field-installable, removable filter/dryer, and more particularly, to a filter/dryer housing used in vapor compression air conditioners, heat pumps, refrigerators and the like which can be attached into the liquid line or vapor line of the system.

Filter/dryers are used to clean refrigerant by removing particles, moisture, and/or acid from the refrigerant by mechanical filtration, adsorption, absorption, or other mechanical and chemical mechanisms. The function of these devices could be referred to as "cleaning" the refrigerant.

The presence of acid in the refrigerant of vapor compression refrigerators, heat pumps, and air conditioners severely shortens the life of both the compressor and the refrigerant. The presence of moisture in the refrigerant of vapor compression refrigerators, heat pumps, and air conditioners leads to the formation of ice crystals in the throttling device, thereby restricting the flow of refrigerant and decreasing capacity. The presence of water in a system also accelerates the formation of acids in the system. Installing a filter/dryer in the system to adsorb moisture and acid (as well as filtering out solid particles) is a common maintenance procedure. These filters are typically located in the liquid line upstream of the expansion device, but are also located in the suction line to trap acid returning to the compressor when a new compressor has been installed after a compressor burn-out.

Aside from the situation where a major repair is being performed on the system (requiring the recovery of the refrigerant and replacement of critical components such as the compressor, evaporator, or condenser), the labor involved in changing an in-line filter/dryer is too cost-prohibitive on smaller, less expensive systems especially when the capacity of the remaining filter/dryer is unknown. Likewise, on systems that do not have a filter/dryer, which are usually smaller, less sophisticated and less expensive systems, the repeated labor costs associated with repeatedly installing an in-line filter/dryer typically keep refrigeration/air conditioning service technicians from ever installing or even changing an existing filter/dryer.

Therefore, if a filter/dryer is installed in a lower-cost system, it is rarely changed. When only one such a filter/dryer is located in a system, it is typically located in the liquid line directly upstream of the expansion device. When a second filter/dryer is utilized for acid control, typically after a burnout, this second filter/dryer is located in the compressor suction line, upstream of the compressor inlet. In either case, the desiccant, adsorption media and filter medium used in these refrigerant filter/dryers is well known in the art as discussed, for example, in U.S. Pat. Nos. 4,665,050; 5,114,584; 5,384,047; 5,364,540; and 5,440,898. This adsorption media is typically located either in a sealed replaceable disposable filter/dryer assembly or in a "replaceable core" filter/dryer.

In the replaceable core configuration, the filter/dryer media is usually formed into a semi-rigid porous structure that is placed into the reusable, refillable replaceable core filter/dryer housing. These replaceable core filter/dryers have been available commercially for many years as seen in the March 1989Sporlan "Catch All" Filter Dryer Bulletin No. 40-10. These removable housing designs are also discussed in U.S. Pat. Nos. 3,286,838; 4,581,903; and 4,683,057, which discuss methods for sealing the filter/dryer core to the interior of the housing so as to prevent by-pass leakage around the filter.

Likewise, the sealed disposable filter/dryer assemblies are also well known in the prior art and are also described in the aforementioned March 1989 Sporlan "Catch All" Filter Dryer Bulletin No. 40-10. In these disposable filter/dryer devices, the filter/dryer medium is either a rigid core like the replaceable core filter/dryer or a loose fill of desiccant/adsorbent material held within the sealed disposable filter housing. There are many different approaches in the design and construction of these disposable replaceable canisters, as seen, for example, in U.S. Pat. Nos. 4,255,940; 4,177,145; 5,240,483; 5,910,165; 5,837,039; 5,425,250; 5,375,327; 5,245,842; 5,215,660; 5,814,136; and 5,522,204, all of which use a loose fill adsorbent material contained within a porous package. This filter/dryer desiccant (adsorbent) material is sealed within the filter/dryer housing. There are also disposable canisters described in U.S. Pat. No. 5,440,898 which utilize a rigid filter/dryer core molded from a permeable matrix of desiccant particles, a binder, and reinforcing fibers.

U.S. Pat. No. 2,017,350 discloses a foot valve and strainer organized to permit co-operation therebetween when in normal use and removal thereof from the device by a simple operation when cleaning or replacement is necessary. While the known replaceable core filter/dryers employ the concept of a removable housing and U.S. Pat. No. 2,017,350 discusses a pressure-actuated foot valve, the prior art did not recognize and certainly did not discuss the need for a method for mechanically sealing (isolating) both the inlet and outlet to the filter/dryer assembly automatically as a direct result of the action of removing the filter/dryer housing, and automatically opening both the inlet and outlet to the filter/dryer assembly automatically as a direct result of the action of attaching the filter cover into the base.

It was also well known in the art prior to the present invention to use a cylindrical filter or filter/dryer element with a cylindrical inner volume for receiving the fluid which is passed through the porous filter media and to fasten and prevent short-circuiting of the fluid from around the ends of the filtering structure within the housing. For example, the aforementioned U.S. Pat. No. 2,017,350 discusses one such fastening method using a rod extending axially through the strainer, whereas U.S. Pat. No. 3,286,838 discusses external springs and U.S. Pat. No. 4,255,940 uses an external spring-and-cap arrangement.

U.S. Pat. No. 5,211,024 discloses a refrigerant filtration system with a filter change indication. A flow meter monitors the volumetric flow of refrigerant through the filter to determine when the filter should be changed as a function of the mass of refrigerant which has been pumped through the filter. This meter does not, however, determine the remaining capacity of the filter. Rather, it simply indicates the need to change the filter/dryer when a particular volume of refrigerant has passed therethrough. Because the remaining drying capacity of the filter/dryer is a direct function of the moisture and acid content of the refrigerant that has passed through and not merely the total mass of refrigerant, this known method is of questionable value, and in fact a simple timer (hour meter) would be of equal utility and result in reduced cost.

Finally, U.S. Pat. No. 5,915,402 discloses an isolation valve including an integral pair of ball valves close coupled by a custom union for disconnecting and replacing the charge refrigeration components. As seen in FIG. 6 of that patent, two such valves can be used with any refrigeration component, including a filter/dryer to allow the component to be removed from the system without removing the entire refrigerant charge of the system. This device, although intended to be convenient, is also more complex than simply using two common refrigeration shut-off (isolation) valves and is essentially similar to using any conventional shut-off valve on both the inlet and outlet side of the component to be removed. Furthermore, this approach does not allow the system to operate when the filter or other refrigeration component located between the two valves has been removed.

SUMMARY OF THE INVENTION

An object of the present invention is to provide for a simple filter/dryer while also providing an accurate, yet simple and inexpensive, indication of the remaining drying capacity of the filter/dryer.

All of the prior art filter/dryers (or other filtering or refrigeration purification devices), whether refillable or replaceable, have one thing in common, namely that the system (or at least the section connected to both the inlet and outlet) must be isolated, the refrigerant removed, the filter/dryer changed, and the system recharged with refrigerant to the proper amount. We have recognized, however, that due to cost saving measures, many air conditioning, heat pump, and refrigeration systems do not have a filter/dryer in the system, and it is expensive and disruptive (to the unit's operation), to retrofit such a filter/dryer in the field. Of course, the equipment installer could install the traditional filter/dryer assembly (either a replaceable type or refillable type with a replaceable core), and install a shut-off valve on both the inlet and outlet of the filter. This allows the filter assembly to be isolated, prior to the filter/dryer change. Furthermore, a service valve could also be installed between these two isolation valves to allow the refrigerant to be recovered prior to removing the filter/dryer. The installation of two valves (which have sealed valve stems or covered valve stems to avoid leaks) along with the filter/dryer and possibly even a service valve is, however, a costly and cumbersome option. The volume of refrigerant trapped between the valves is also greater than the refrigerant trapped in our compact configuration.

An object of the present invention is to not only allow for rapid change-outs with significant refrigerant recovery but also to allow for operation when the filter/dryer housing has been removed. Therefore, there is no loss in performance during the filter/dryer core change, and this change can be quickly and easily performed. In a currently preferred configuration of the present invention, the filter/dryer core is placed in the filter/dryer housing and is attached to the base automatically so as to seal the core volume from the environment. The action of turning the internal valve spool engages the filter/dryer core into the refrigeration stream.

In an alternative configuration of the present invention the filter/dryer assembly can be configured in a fail-safe manner where the action of attaching the filter/dryer housing to the filter/dryer base automatically engages the filter/dryer core into the refrigeration stream. Both configurations allow the filter/dryer housing to be evacuated prior to opening this compartment to the refrigerant by evacuating the filter/dryer housing, via the service port on the housing.

Once installed, either when the system is assembled or is retrofitted afterward, the configuration of the present invention allows the filter/dryer medium to be easily changed while the system is operating, without recovering refrigerant from the entire system, and only requires evacuating the filter housing where the filter is located. The present invention uses an internal spool valve to isolate the internal volume of the housing for removal of the filter/dryer medium contained inside. The alternate configuration allows for the simultaneous and automatic isolation of the filter chamber and removal of the filter/dryer medium contained inside by unscrewing the filter/dryer housing cover.

The present invention simplifies the changing of the active filter/dryer medium out in the field, without the need to isolate a significant section of the system, recover a large volume of trapped refrigerant, install the traditional filter/dryer into the system, and recharge the section previously isolated and evacuated. The filter/dryer substance is held in a rigid cover housing which when tightened on the filter base automatically seals the cover housing to the base. Rotation of the internal valve spool then reroutes refrigerant through the filter assembly. In the currently preferred configuration, the rotation of the internal valve spool automatically reroutes the refrigerant from a by-pass pathway and through the filter. In the one alternative configuration, this opens the filter housing to the refrigerant flow from a shut-off configuration. The alternative configuration requires, however, a by-pass cover to allow by-pass operation.

This invention allows a technician out in the field to easily, simply, quickly and inexpensively change a filter/dryer without the need for any significant interruption of the operation of the system. This filter/dryer media(desiccant, adsorbent or filter material) located inside the filter/dryer housing can also contain an indicator on the filter/dryer medium which, along with a sight-glass in the housing, can be used to indicate if the dryer capacity (ability to capture moisture and acid) has been exhausted or if additional dryer capacity remains.

The present invention can be configured from any machinable or castable material and consists of five basic components, namely the filter/dryer base with a inlet and outlet for connecting into a vapor compression refrigeration, air conditioning or heat pump system, a filter/dryer cover housing with mechanical structure for attaching to the base and sealing the internal volume, a filter/dryer core which fits inside the housing and is fabricated from methods well known in the art into a rigid block or loose fill (with an outside porous containment structure) using desiccant, adsorbent, or filtering materials, an internal valve spool which can direct the flow of refrigerant (through the filter core or bypass the filter core), depending on its position in the base, and a valve spool cover housing which can be mechanically connected to the body for protection and secondary sealing around the protruding portion of the valve spool.

An alternate configuration of the present invention also includes a torque transmitting device for transferring the engaging motion of the internal valve spool, and a spool valve that can be positioned to isolate the inlet and outlet.

Additional contemplated features include a color-changing indicator chemical deposited on the filter/dryer core media to indicate remaining adsorption capacity and a sight glass in the cover to allow viewing of the media which has been so treated. The present invention further contemplates the inclusion of a service port, such as a Schrader valve, to allow the cover to be evacuated after it engages the base (or to allow refrigerant to be recovered to prior to opening the cover to the atmosphere). Moisture indicators can be placed on the adsorption media so that, if additional adsorption capacity is available, the indicator then will indicate "dry" and if no additional adsorption or desiccant capacity is available, they will indicate "wet" as additional moisture enters the system.

Specifically, we currently contemplate use of a moisture indicator such as cobaltous chloride ($CoCl_2$) or cobaltous bromide ($CoBr_2$). $CoCl_2$ will hydrate with six water molecules changing from blue color to pink color. $CoBr_2$ will hydrate with six water molecules changing from green color to yellow color. Because these moisture indicators are attached to the dryer material, they will indicate dry if there is additional drying capacity in the material.

Other chemicals which also change color upon hydration including copper sulfate and other cobalt compounds can be utilized. Certain alkali metal ozonides change color as well. Acid-base reactions can also be used in conjunction with proper indicators. While many commercial indicators are available, the currently preferred embodiment of this invention will use $CoCl_2$ as the indicator. If the moisture concentration is not enough to turn the indicator completely pink, however, an intermediate color, between blue and pink (pale, almost white) will be observed. Therefore, the intensity of the change depends on what percentage of the indicator has been transformed (reacted) to the wet form.

If the $CoBr_2$ indicator is used, a wet environment (exhausted dryer capacity) will produce a yellow color, whereas in a dry environment (remaining dryer capacity) the indicator chemical will appear green. If the moisture concentration is not sufficient to turn the indicator completely yellow, however, an intermediate color, between green and yellow (that is some yellowish shade of green) will be observed. Therefore, the intensity of the color change depends on what percentage of the indicator has been transformed (reacted) to the wet form and therefore indirectly into the remaining drying capacity of the filter/dryer core element.

Thus, the present invention takes advantage of the difficulty and cost of normally attaching a filter/dryer into the plumbing of an existing (working) system.

The present invention is also fail-safe in that the filter dryer housing is either in a by-passed, flow-through state, and in one alternative configuration, a totally shut-off state, making it much less likely for the technician to accidentally leave a valve in the wrong position during a filter change. In a system with separate inlet and outlet shut-off valves, if either of the two isolation valves were left closed after a new filter/dryer were installed, the system would be blocked, resulting in excessive pressure being developed by the compressor and if a high-pressure safety device were not present (which is also the case in many lower cost systems), the compressor would fail.

Once initially installed, the present invention allows a quick filter change to be performed. Furthermore, an alternative by-pass cap can be used, when initially installed, to lower the first-cost of installation. This by-pass cap can be simply and quickly field-changed to install and filter/dryer at a later time. Alternatively, the filter housing without the filter/dryer media could, of course, be installed. This latter approach is useful because many residential air conditioner installations in new construction are performed by the lowest cost subcontractor, and to reduce their costs, only the basic components are installed. This filter assembly can be installed without the filter cover and filter, and in so doing, the future owner can elect to simply add the filter cover and filter/dryer during an air-conditioning service call without requiring a major installation. The by-pass cap is simply unscrewed, and the filter/dryer cover housing and filter/dryer are screwed on.

To further lower the cost of this filter/dryer installation and allow a lower cost option for the initial installation, the one alternative configuration of the filter/dryer housing can also function as a shut-off device. That is, either isolation valve (the isolation valve located on the liquid line of the condensing unit of an split-system air conditioner or heat pump, or the vapor line located on the vapor line of the condensing unit of a split system air conditioner) can be replaced with the alternative configuration filter/dryer housing to lower installation cost, because this filter/dryer housing can also function as an isolation valve and, therefore eliminate the need for the latter.

BRIEF DESCRIPTION OF THE DRAWINGS

These and other objects, features and advantages of the present invention will become more readily apparent from the following detailed description of currently preferred configurations thereof when taken in conjunction with the accompanying drawings wherein.

DETAILED DESCRIPTION OF THE DRAWINGS

Figure 1:
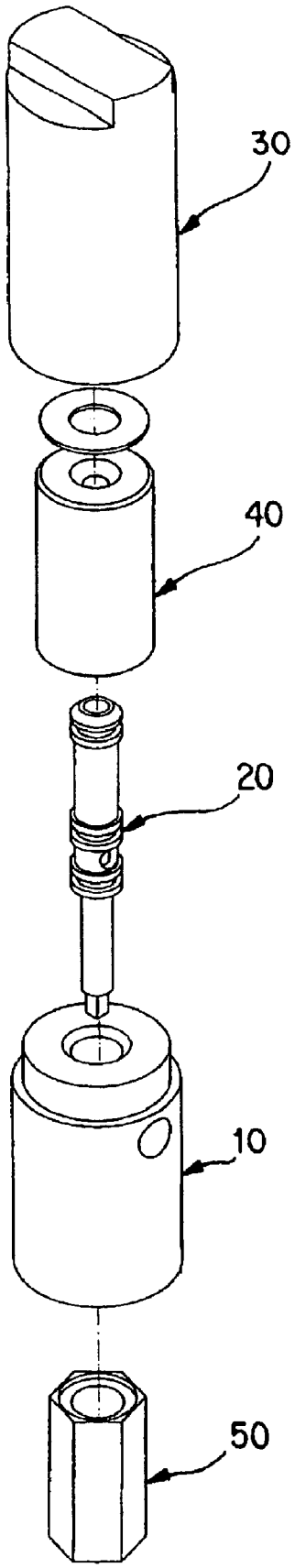
FIG. 1 is an exploded perspective view of a currently preferred embodiment of the filter/dryer assembly of the present invention with the filter/dryer core in place.
Figure 2:
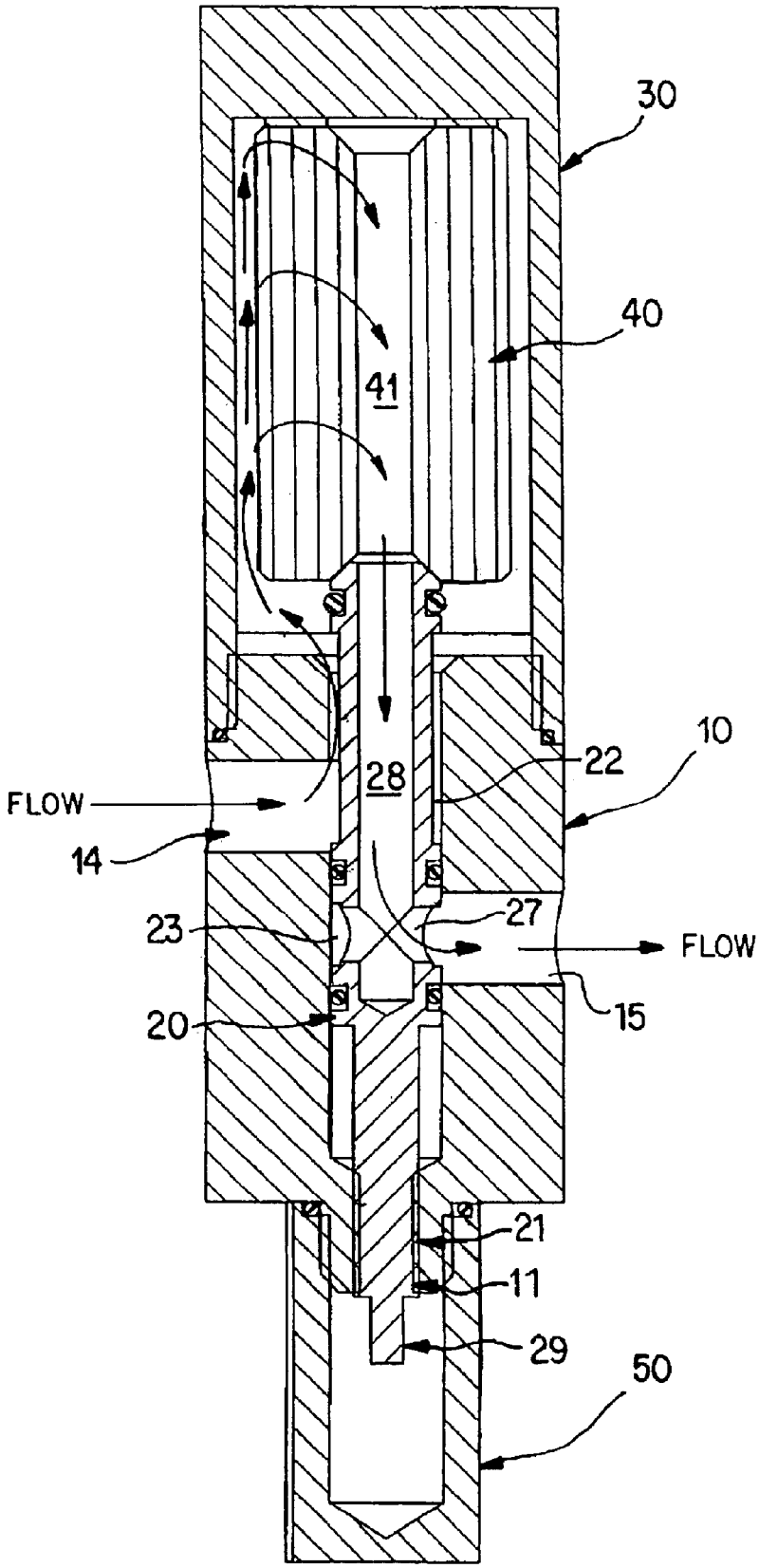
FIG. 2 is a cross-sectional view of the preferred embodiment of the completely assembled filter/dryer assembly shown in FIG. 1, with a filter/dryer core installed and the refrigerant flow path detailed by arrows.
Figure 3:
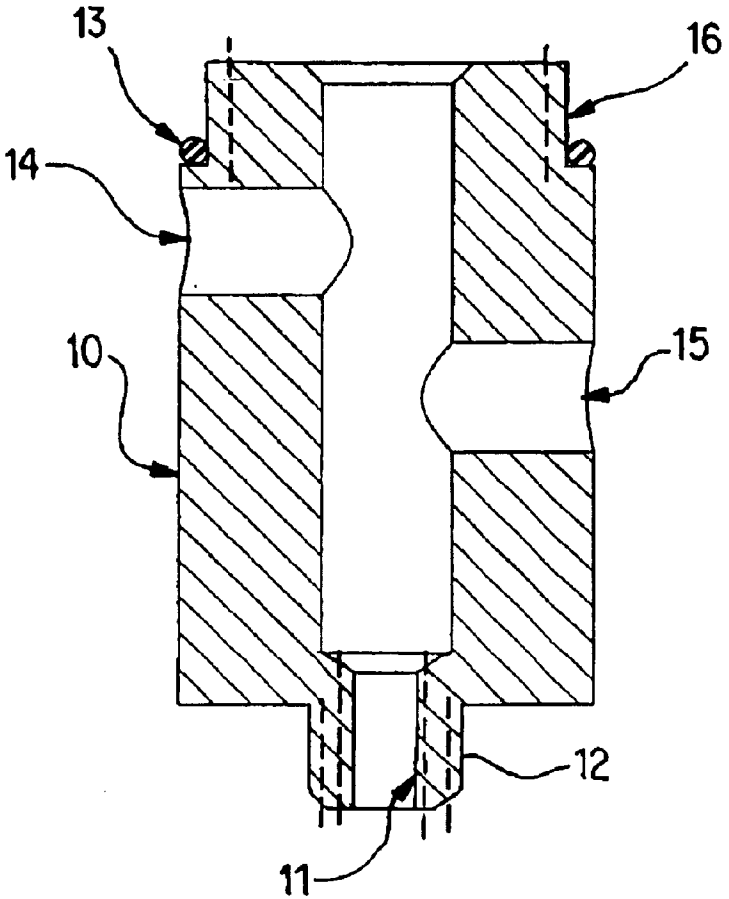
FIG. 3 is a cross-sectional view of a currently preferred embodiment of the base of the filter/dryer assembly of the present invention.

Referring now to FIGS. 1, 2 and 3, the overall assembly generally includes a filter/dryer base 10, an internal valve spool assembly 20, a filter/dryer cover 30, a filter/dryer core 40, and a valve spool stem sealing cap 50 as the major components. As shown in FIG. 3, the base 10 has an internal thread 11 (schematically shown), an external thread 12 (schematically shown), a sealing O-ring 13, a refrigerant inlet port 14, a refrigerant outlet port 15, and external threads 16 (schematically shown) for attachment to the filter/dryer cover 30. It is contemplated that brazed or soldered connections used in the inlet port 14 and/or outlet port 15 can be replaced with conventional National Pipe Threads (NPT) or refrigeration flare fittings, although this is not essential to the practice of the invention.

Figure 4:
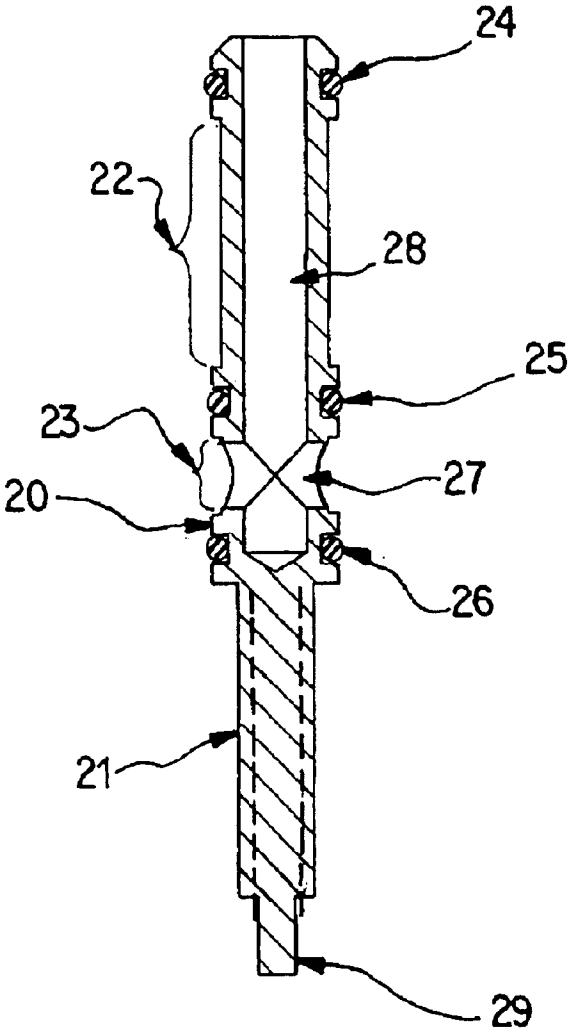
FIG. 4 is a cross-sectional view of a currently preferred embodiment of the valve spool assembly of the filter/dryer assembly of the present invention.

Referring now to FIG. 4, the internal spool valve assembly 20 shown in FIGS. 1 and 2 has an external thread 21 (schematically shown), two circumferential refrigerant passageways 22 and 23; three O-ring grooves 24, 25 and 26; a cross-drilled radial fluid passageway 27; a cylindrical center refrigeration channel 28; and an external flat surface 29 to be engaged by a wrench for movement.

Figure 5:
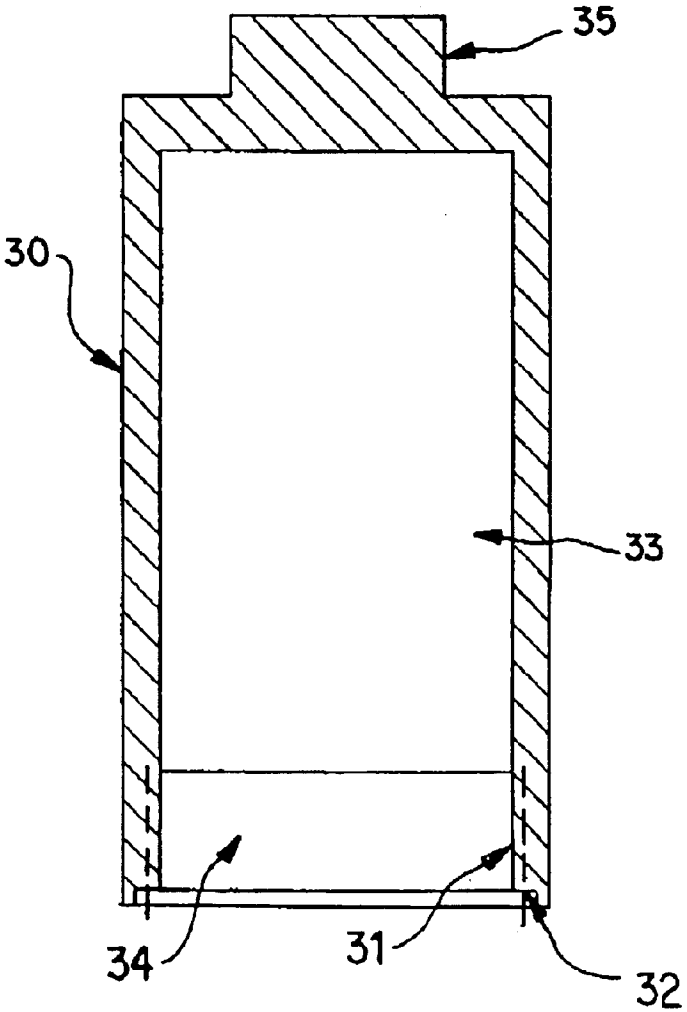
FIG. 5 is a cross-sectional view of a currently preferred embodiment of the filter/dryer cover of the filter/dryer assembly of the present invention.

Referring now to FIG. 5, the filter/dryer cover 30 shown in FIGS. 1 and 2 contains an internal thread 31 (schematically shown), a refrigerant sealing O-ring groove 32, a cylindrical void or space 33 for accommodating the filter/dryer, a cylindrical void or space 34 for engaging the base 10, and an external flat surface 35 to be engaged by a wrench for tightening.

Figure 6:
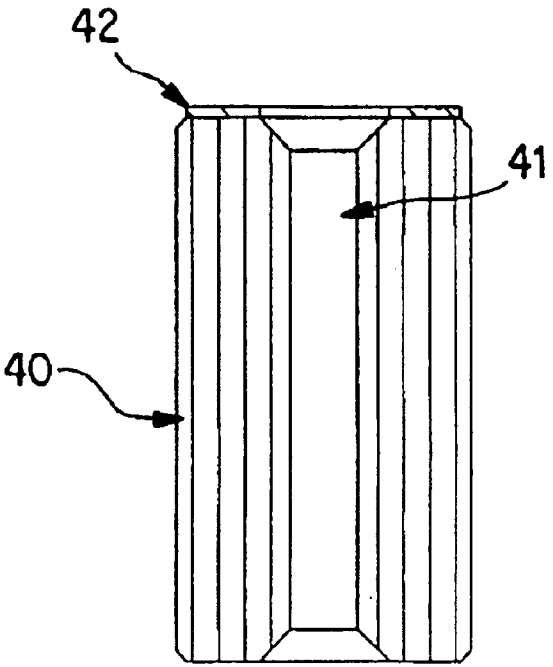
FIG. 6 is a cross-sectional view of a currently preferred embodiment of the filter/dryer of the filter/dryer assembly of the present invention.

Referring now to FIG. 6, the filter/dryer core 40 shown in FIGS. 1 and 2 has a porous cylindrical shape with outside cylindrical dimensions sized to allow the core 40 to fit inside the filter/dryer cover 30 with clearance for refrigerant to flow around the core 40, and an internal cylindrical or annular void 41 for receiving and directing the refrigerant which has flowed through the filter/dryer media. Some mechanism is also necessary for preventing refrigerant flow from outside to the inside cylindrical space or void 41 without passing through the porous filter/dryer media. A simple core cover and spring is one of a number of contemplated solutions that can be implemented by means well known in the art. For simplicity, we have instead used a conventional gasket washer 42 which serves to seal the top of the filter/dryer core 40 and prevent short circuiting of the flow from the outside to inside without flowing through the filter medium. The bottom end of the core 40 is sealed by the action of the tapered nose of the internal spool valve assembly 10 contacting the base of the filter medium 40, and is a simple way to keep fluid from bypassing from the outside to the inside via short-circuiting (over the ends) of the core 40. It is to be understood, however, that numerous other methods could be used without departing from the scope of the present invention. When a sight glass is used, the gasket washer 42 can be treated with acid and/or moisture-indicating substances.

Figure 7:
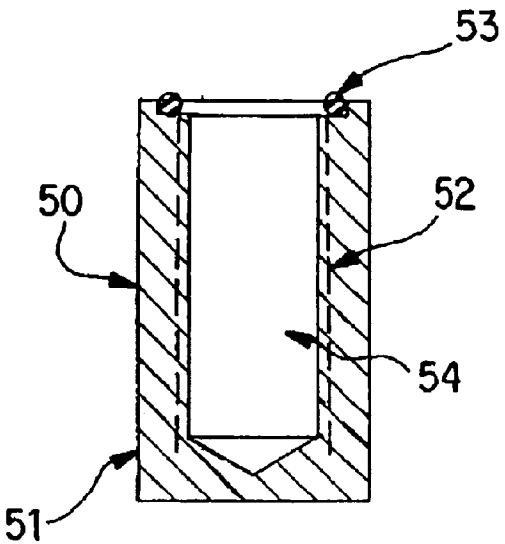
FIG. 7 is a cross-sectional view of a currently preferred embodiment of the valve spool stem cover of the filter/dryer assembly of the present invention.

Referring now to FIG. 7, the valve stem sealing cap 50 shown in FIGS. 1 and 2 has external flats 51 for a wrench to tighten conventional internal threads 52 (schematically shown by dashed line) for attachment to the external threads 12 of the base 10, an O-ring 53 for sealing against the base 10, and an internal volume 54 for clearance around external flats 29 of the internal valve 20.

FIG. 2 is an assembly view showing the completed filter/dryer assembly with the refrigerant flow path detailed in a normal filtering configuration. The internal threads 11 of the base 10 are engaged with the external threads 21 of the valve assembly 20. Refrigerant flow is directed through the inlet 14 in the base 10, through the annular clearance 22 (see also FIG. 4) between the valve spool assembly 20 and the base 10 (which is created when the valve assembly 20 is rotated to position it in the desired location) and around the exterior of the filter/dryer core 40 via the cylindrical filtering chamber formed by the cylindrical void 33 of the filter/dryer cover 30. The internal threads 31 and refrigerant sealing surface 32 have engaged the external threads of the base 16 and the sealing O-ring surface 13 on the base 10, respectively. Refrigerant passes through the filter/dryer core 40 to the central internal cylindrical void or space 41 of the core 40 (as seen by the solid curved arrows) where it then flows into the cylindrical center refrigeration passageway 28 of the valve assembly 20 through the cross-drilled radial fluid passageway 27, through the annular clearance 23 between the valve spool assembly 20 and the base 10 (see also FIG. 4), and out of the refrigeration outlet port 15 of the base 10.

Figure 8:
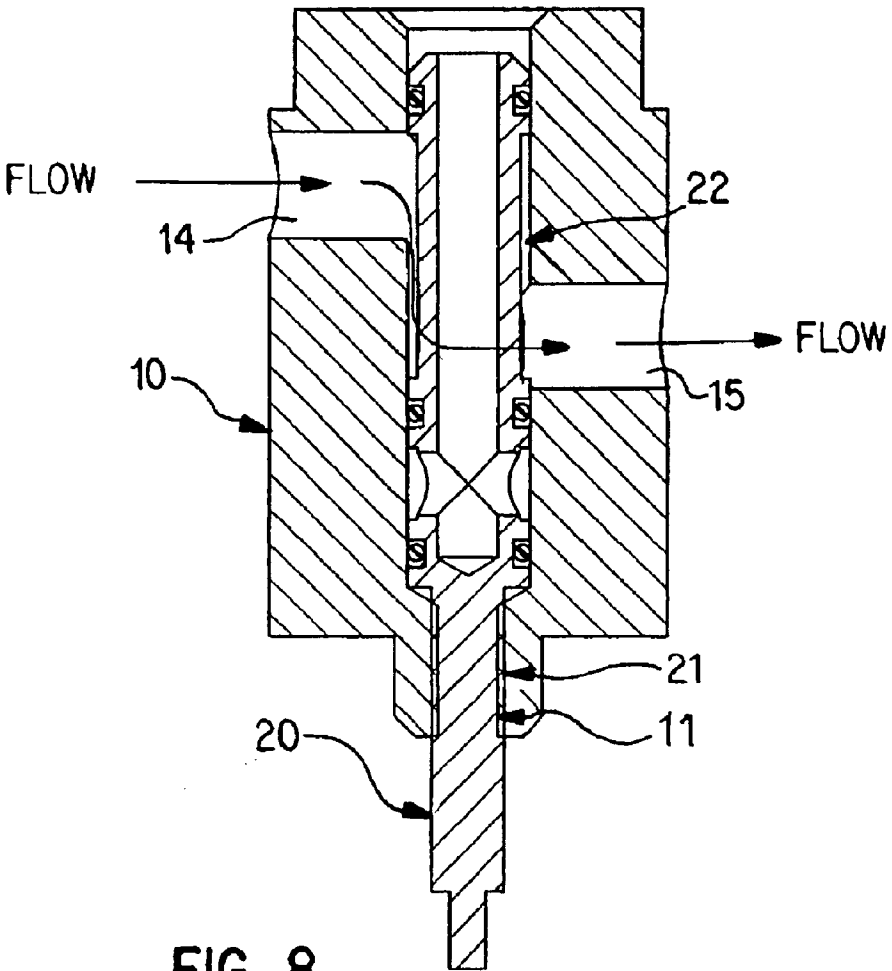
FIG. 8 is a cross-sectional of the filter/dryer assembly shown in FIGS. 1 and 2 configured into the filter change position with the filter/dryer cover and core removed and the refrigerant flow path detailed.

Removing the sealing cap 50 exposes the end of the flats 29 of the internal valve spool assembly 20. The internal valve 20 is rotated to the by-pass position using a wrench or service tool on the flats 29. By rotating the filter/dryer cover 30 of FIG. 2, the cover 30 can be unscrewed from the base 10 as shown in FIG. 8 which shows the change filter/dryer by-pass position with the filter/dryer core 40 and cover 30 removed, the refrigerant flow path in the by-pass configuration being detailed by the solid bent arrow. The internal thread 11 of the base 10 is engaged with the external thread 21 of the valve assembly 20. Refrigerant flow is directed through the inlet 14 of the base 10, through the circumferential passageway 22 (formed by the clearance between the valve spool assembly 20 and the base 10) and out of the refrigerant outlet port 15 of the base 10, and is prevented from leaking into the environment by O-rings in the valve spool assembly grooves 24, 25, and 26 (FIG. 4).

Figure 9:
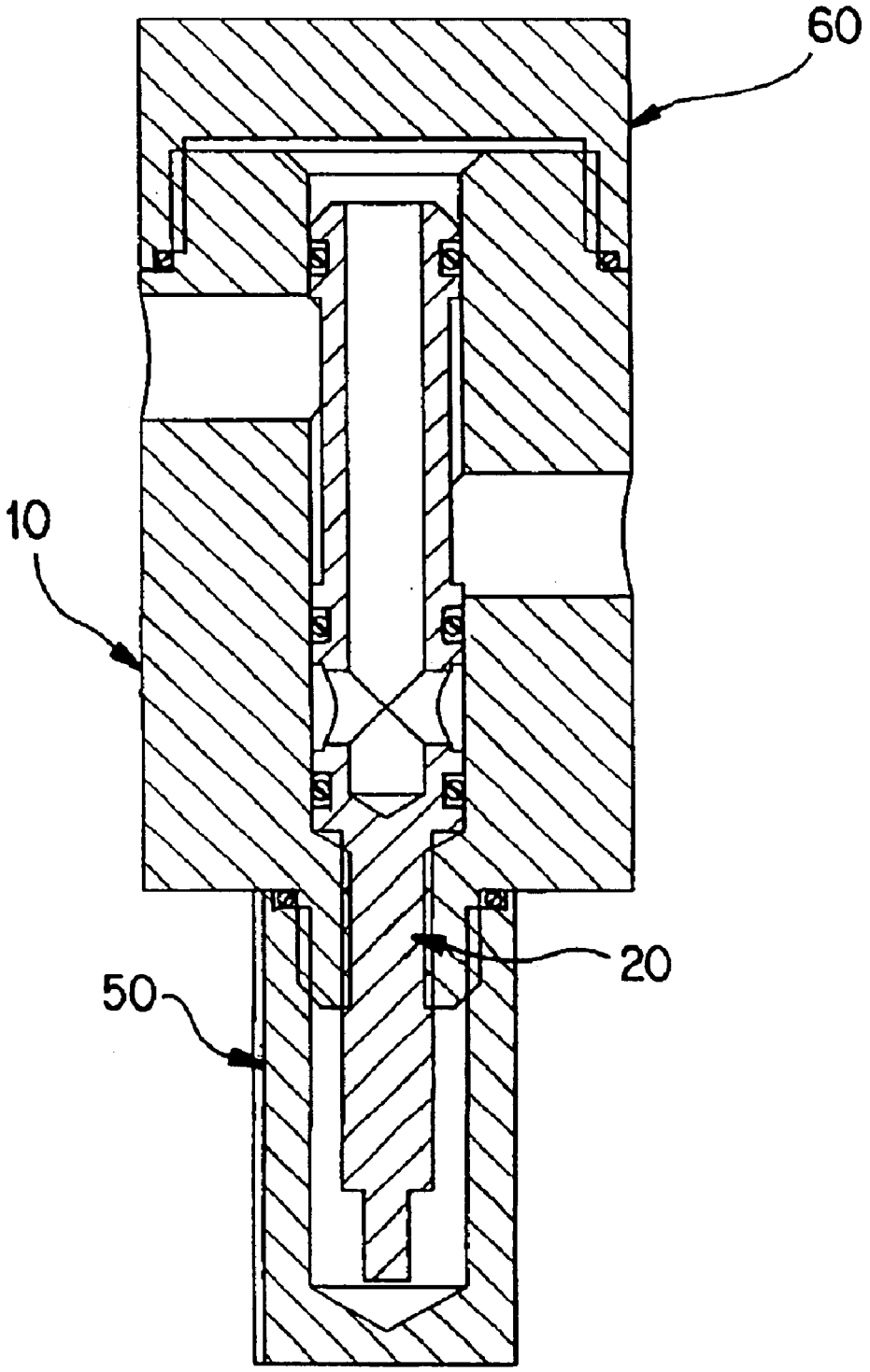
FIG. 9 is a cross-sectional view of the filter/dryer housing of FIG. 8 with the protective cap installed.

The above-described configuration allows the filter/dryer to be changed without interrupting system operation. Nevertheless, there will be only very minimal leakage through the O-rings over an extended period of time because long-term leakage past the bottom O-ring 26 is prevented by using the cap 50 to cover the base of the valve when it is not being adjusted. Likewise, if it is anticipated that an extended period of operation without the filter/dryer will occur, the filter/dryer cover 30 could be installed without the filter/dryer core 40. As an alternative, however, to further reduce cost, a simpler and less expensive cover could be used and later changed when it is desired to add a filter/dryer at some future date. FIG. 9 is a cross-sectional view of the assembly with such a sealing-only cap 60. The refrigerant flow path (not shown) is, however, the same as shown in FIG. 8.

Figure 10:
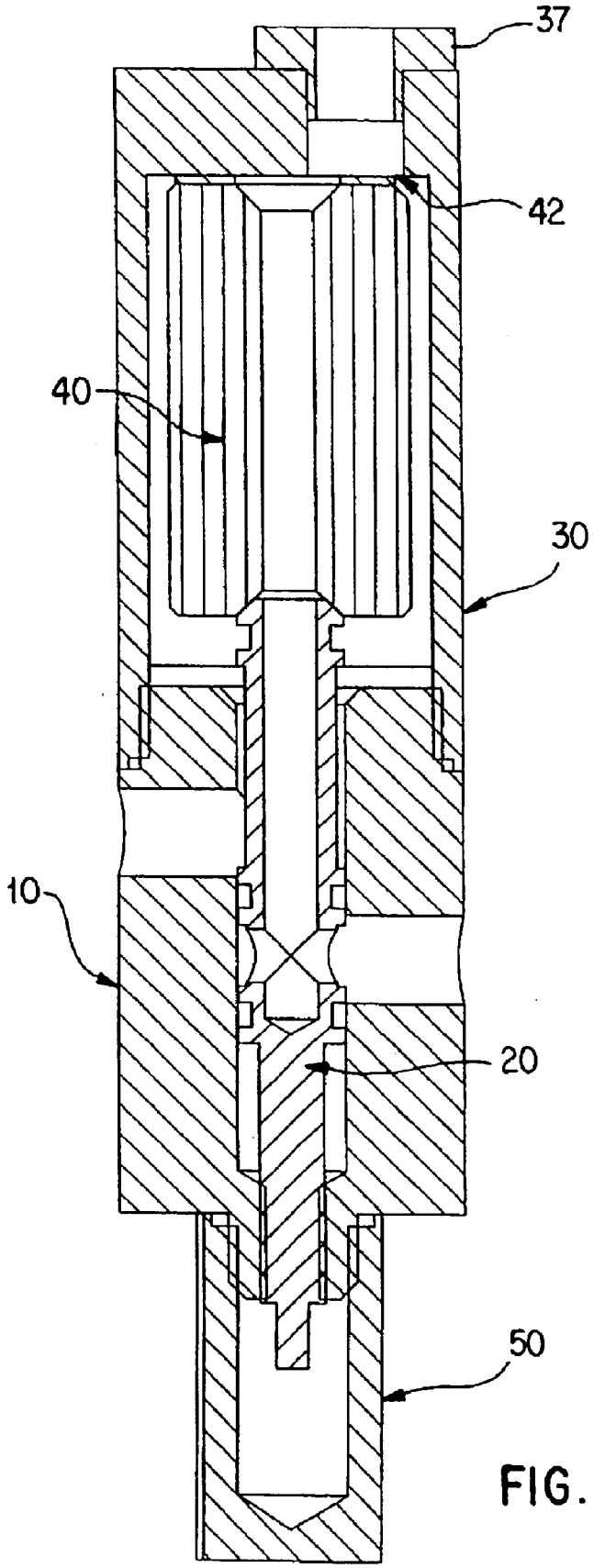
FIG. 10 is a cross-sectional view of the preferred embodiment of the filter/dryer cover, with the moisture and/or acid indicating substance located on the gasket paper which is used to seal the top side of the filter and prevent short-circuiting of the refrigerant flow from outside to inside without flowing through the filter material.

FIG. 10, which is similar to FIG. 2, is a cross-sectional view of the filter/dryer assembly with an optional sight-glass 37 located in the filter/dryer cover 30, and with a moisture-indicating substance (not separately visible, but see FIG. 12) provided on the filter/dryer core gasket 42 and situated so as to be viewable through the sight-glass 37. The numerals used in FIG. 10 and the following figures, including the primed numbers, that are used in FIGS. 13 through 20 identify parts substantially the same as those parts used in FIGS. 1 through 9 except where shown or described to be otherwise.

Figure 11:
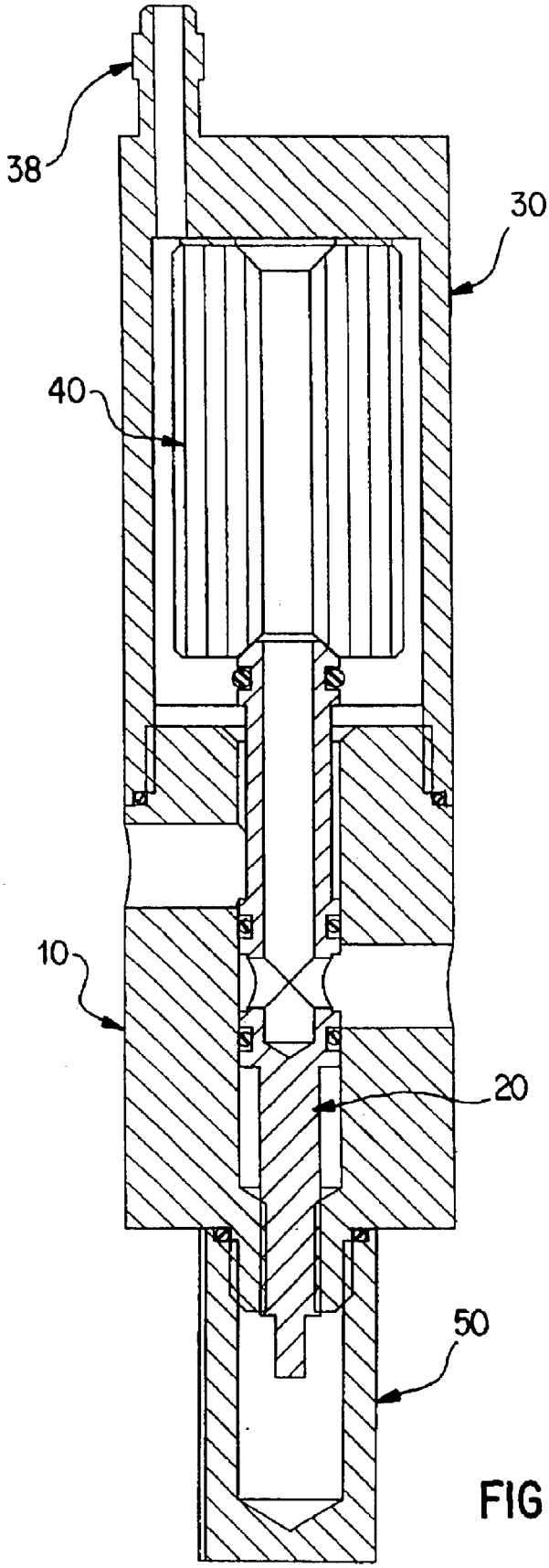
FIG. 11 is a cross-sectional view of a currently contemplated embodiment of the filter/dryer assembly with an optional Schrader valve located in the filter/dryer cover.
Figure 12:
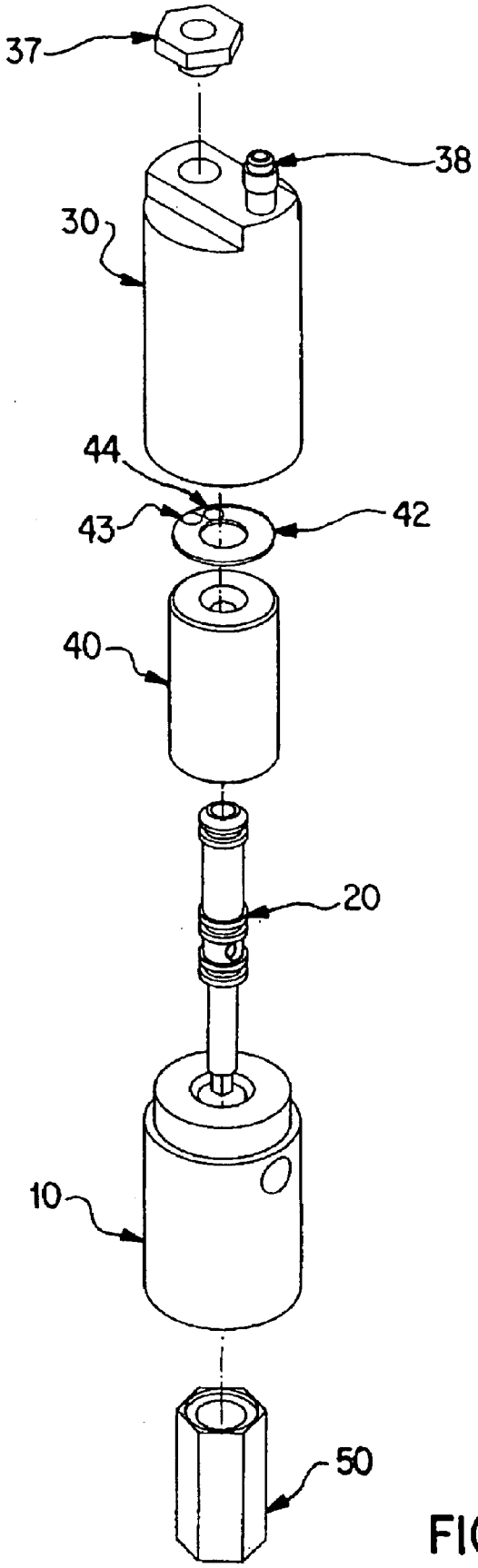
FIG. 12 is an exploded view of the filter/dryer assembly of FIGS. 10 and 11 containing the optional Schrader valve and sight-glass on the cover in this case with the acid or moisture-indicating substance is on the top of the filter/dryer core in the viewing range of the sight glass.

FIG. 11, which is also similar to FIG. 2, is a cross-sectional view of the filter/dryer assembly with an optional known-type of Schrader valve 38 located in the filter/dryer cover 39. FIG. 12 is, like FIG. 1, an exploded view of the filter/dryer assembly containing the optional Schrader valve 38 and sight-glass 37 on the cover as shown in FIGS. 10 and 11, as well as the moisture-indicating substance 43 on the filter/dryer core and an acid-indicating substance 44 on the filter/dryer core.

It is also currently contemplated within the scope of the present invention that the base 10 can be cast to reduce manufacturing costs. There are numerous methods for attaching refrigeration plumbing to the inlet and outlet, including, for example, threaded and flare fittings, brazing, soldering, etc. While soldering or brazing is the best way to assure leak free operation, the base must then be fabricated from a material which can be easily field-soldered or brazed using a flame torch. This increases the cost of materials, but lowers the machining operations required since precision threads or flare surfaces are not necessary.

It is also within the contemplation of the present invention to place an acid indicating substance 44 in place of, or in addition to, the moisture-indicating substance 43 on the filter/dryer core 40, or on the gasket material 42, because either indicator would indicate when the capacity of the filter/dryer has been exhausted inasmuch as the filter/dryer removes both acid and water. These indicating substances can be deposited directly on the filter/dryer material, deposited on the outer surface of the filter/dryer, deposited on the gasket 42 sealing the filter 40 to the cover 30 or fabricated into a pad and located on or near the filter/dryer core 40. These indicator substances must, of course, be within the viewing area of the sight-glass 37, and the sight-glass can be located anywhere that will allow the interior refrigerant space and the indicator to be seen.

Figure 13:
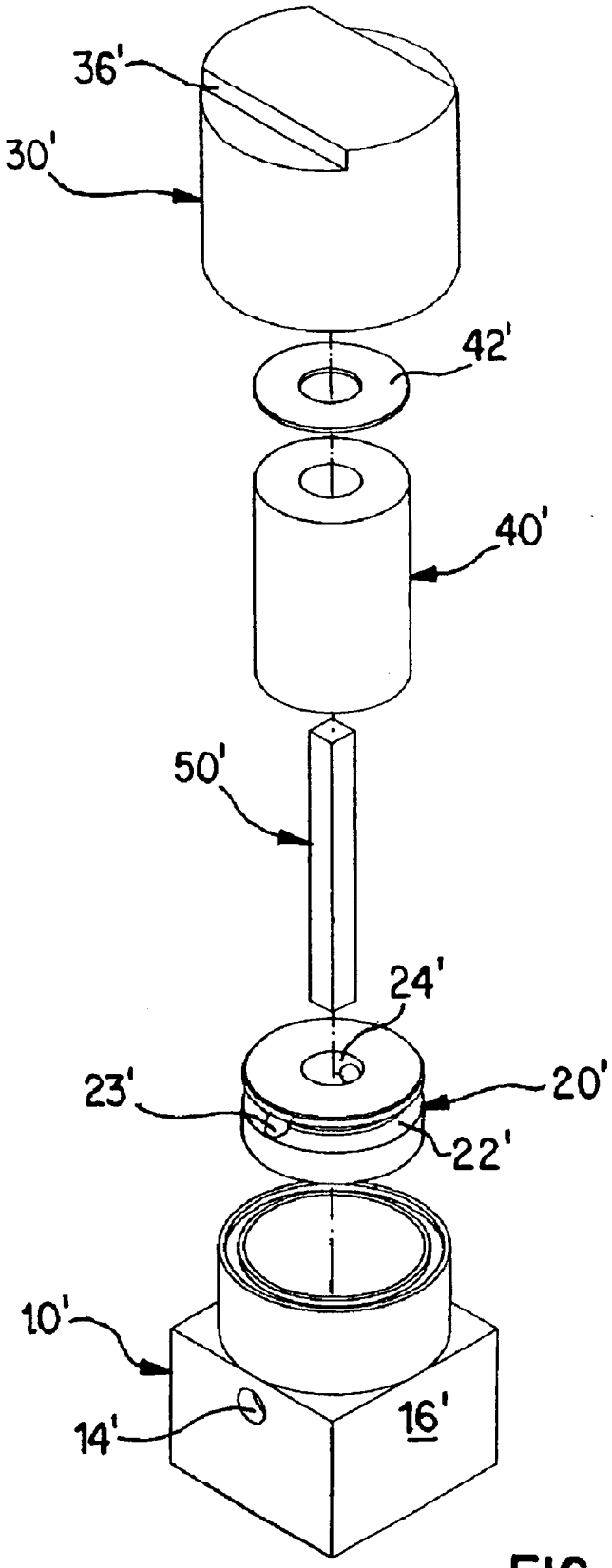
FIG. 13 is an exploded perspective view of one alternate configuration of the filter/dryer assembly of the present invention with the filter/dryer core in place.
Figure 14:
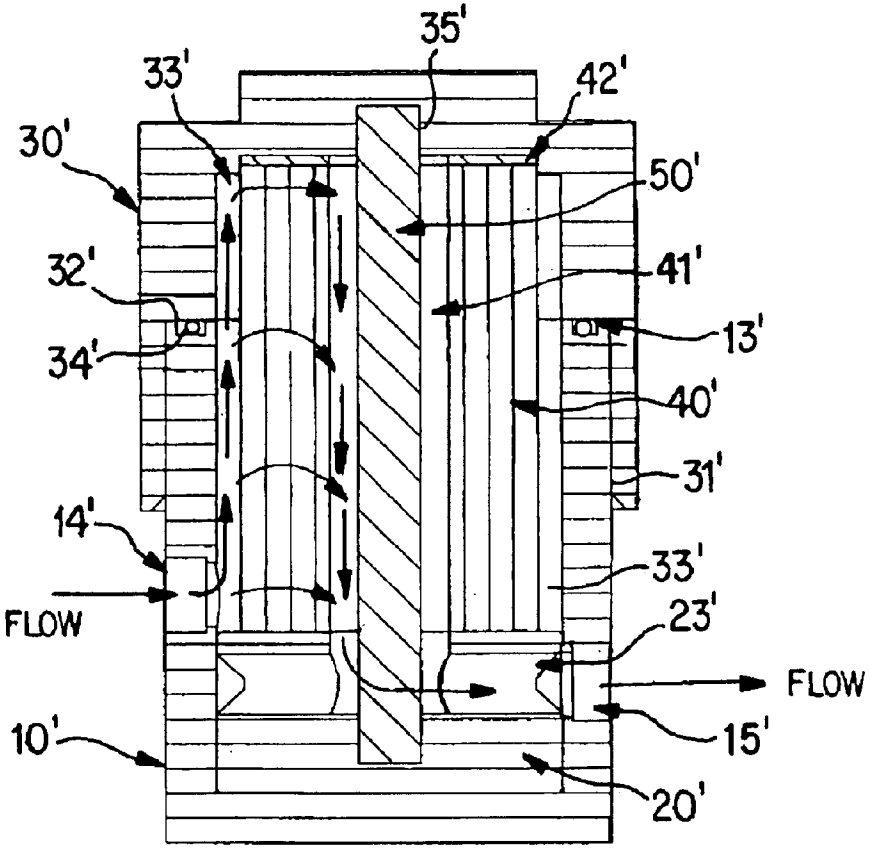
FIG. 14 is a cross-sectional view of the alternative configuration of the filter/dryer assembly shown in FIG. 1, with a filter/dryer core installed and the refrigerant flow path detailed.

FIGS. 13 and 14 show an alternative configuration for the overall assembly which generally includes a filter/dryer base 10', an internal valve assembly 10', a filter/dryer cover 30', a filter/dryer core 40', and a torque transmitting device 50' as the major components.

Figure 17:
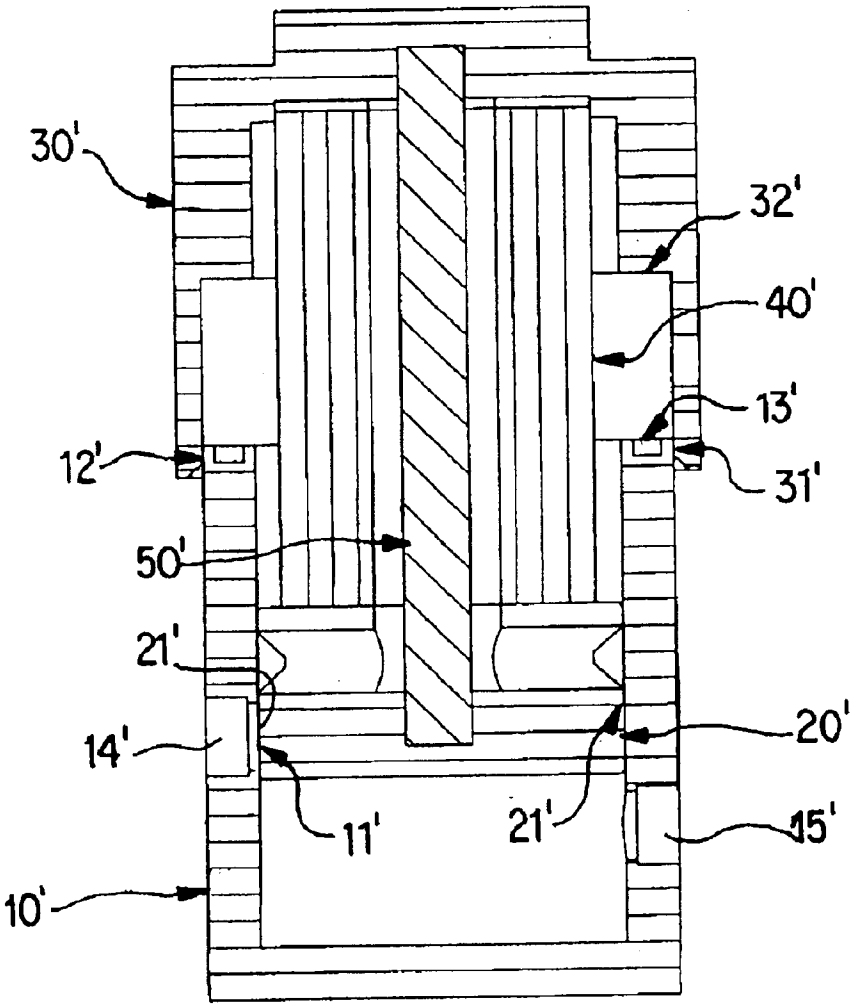
FIG. 17 is a cross-sectional view of the filter/dryer assembly with the filter/dryer core located in the cover and the cover just engaging the base, this configuration being used for evacuating the cover and filter/dryer volume, before engaging the filter/dryer into the refrigerant stream on a new filter/dryer installation also being the position for refrigerant recovery, before the filter/dryer cover is removed on the filter/dryer.

The base 10' has conventional internal and external threads 11', 12' similar to that shown in FIG. 17, a sealing O-ring 13', a refrigerant inlet port 14', a refrigerant outlet port 15' and external flat surfaces 16' to be engaged by a wrench for tightening. The brazed or soldered connections used in the inlet port 14' or outlet port 15' can, of course, be replaced with conventional National Pipe Threads (NPT) or refrigeration flare fittings without departing from the principles of the present invention.

The internal valve spool assembly 20' has an external thread 21' similar to that shown in FIG. 17, a circumferential refrigerant passageway 22', a cross-drilled radial fluid passageway 23', a cylindrical center refrigeration distribution manifold 24', and a torque coupling hexagonal female socket 25'.

The filter/dryer cover 30' contains an internal thread 31', a refrigerant sealing surface 32', a cylindrical void or space 33' for accommodating the filter/dryer, a cylindrical void or space 34' for engaging the base 10', a torque coupling hexagonal female socket 35', and external flat surfaces 36' to engage a wrench for tightening.

The filter/dryer core 40' has a porous cylindrical shape with outside cylindrical dimensions sized to allow the core 40' to fit inside the filter/dryer cover 30' with clearance for refrigerant to flow around the core 40', and an internal cylindrical or annular void 41' for receiving and directing the refrigerant which has flowed through the filter/dryer media. Some mechanism is also necessary for preventing refrigerant flow from outside to the inside cylindrical space or void 41' without passing through the porous filter/dryer media. A simple core cover and spring is one of many possible solutions well known in the art.

For simplicity, we have instead used a conventional elastomeric washer 42' which serves to center the filter/dryer core 40' in the housing of the larger-bore cover 30' to seal the end of the core 40' to avoid short-circuiting over the top and to press (due to its compression during tightening) the core 40' against the internal valve 20' to avoid short-circuiting over the ends of the core. This is a simple way to keep fluid from bypassing from the outside to the inside via short-circuiting (over the ends) of the core 40. Again, it is to be understood, however, that numerous other methods could be used without departing from the scope of the present invention.

FIG. 14 is a cross-sectional view of the alternative configuration of the filter/dryer assembly of FIG. 13, with the refrigerant flow path detailed by arrows. An internal thread of the base 10' is engaged with an external thread of the valve assembly 20'. Refrigerant flow is directed through the inlet 14' in the base 10', over the top of the internal valve assembly 20' and around the exterior of the filter/dryer core 40' via the cylindrical filtering chamber formed by the cylindrical void 33' of the filter/dryer cover 30', wherein an internal thread and refrigerant sealing surface 32' have engaged external threads and the sealing O-ring surface 13' on the base 10', respectively. Refrigerant passes through the filter/dryer core 40' to the central internal cylindrical void or space 41' of the core 40' (as shown by the curved arrows), where it then flows in to the cylindrical center refrigeration distribution manifold of the valve assembly 20' through the cross-drilled radial fluid passageways 23', into the circumferential refrigerant passageway 26' and out of the refrigerant outlet port 15' of the base 10'.

Figure 15:
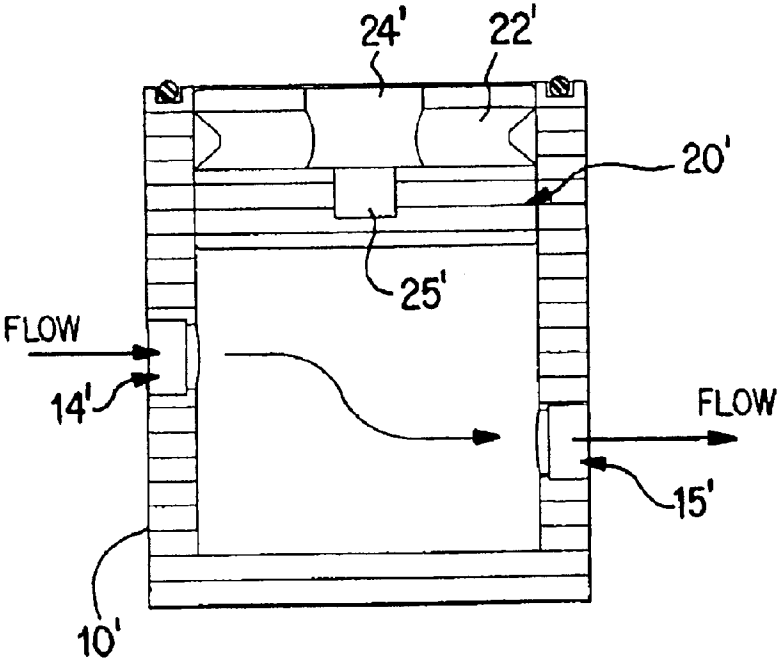
FIG. 15 is a cross-sectional of the filter/dryer assembly shown in FIGS. 13 and 14 configured into the filter change position with the filter/dryer cover and core removed and the refrigerant flow path detailed.

By rotating the filter/dryer cover 30' of FIG. 14, the cover 30' can be removed from the base 10'. As the cover 30' is rotated, the torque transmitting device 50' is also rotated to cause the internal valve 20' also to rotate, thereby causing the internal spool valve assembly 20' to move to the upper location in the base 10' as shown in FIG. 15 which is a cross-sectional view of the filter/dryer assembly in the (change filter/dryer) by-pass position with the filter/dryer core 40' and cover 30' removed, with the refrigerant flow path again being detailed by the arrows. The internal thread of the base 10' remains engaged with the external thread of the valve assembly 20'. Refrigerant flow is directed through the inlet 14' in the base 10', under the bottom of the valve assembly 20' and out of the refrigerant outlet port 15' of the base 10'.

Figure 16:
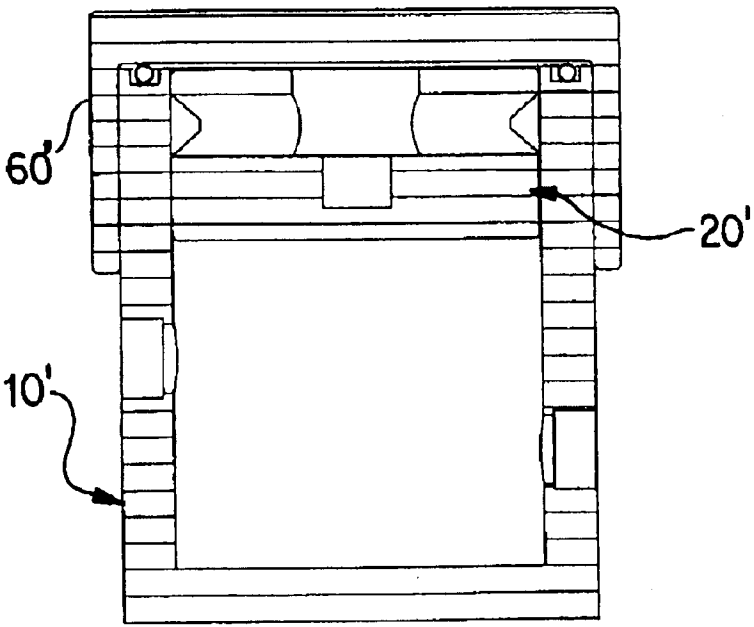
FIG. 16 is a cross-sectional view of the alternative configuration of the filter/dryer as shown in FIG. 15 with the protective cap installed.

The above-described configuration allows the filter/dryer to be changed without interrupting operation. Of course, there will be some very minimal leakage through the threads over an extended period of time. Therefore, if it is anticipated that an extended period of operation without the filter/dryer will occur, the filter/dryer cover 30' can be installed without the filter/dryer core 40' and the torque transmitting device 50'. As an alternative, however, to further reduce cost, a simpler and less expensive cover can be used and later changed to one which cooperates with the torque transmitting device 50' when it is desired to add a filter/dryer at some future date. FIG. 16 is a cross-sectional view of the assembly of FIG. 15 with such a sealing-only bypass cap 60' installed. The refrigerant flow path (not shown) is, however, the same as shown in FIG. 15.

FIG. 17 is a cross-sectional view of the filter/dryer assembly of FIGS. 13 and 14, in which the filter/dryer core 40' located in the cover 30' and the cover 30' itself just engage the base 10'. This is the configuration used for evacuating the cover 30' and filter/dryer volume, before engaging the filter/dryer into the refrigerant stream on a new filter/dryer installation. It is also the position for refrigerant recovery, before the filter/dryer cover 30' is removed. The internal threads 11' of the base 10' remain engaged with the external threads 21' of the valve assembly 20', and the external threads 12' of the base 10' have just engaged, or just remain engaged with, the internal threads 31' of the filter/dryer cover 30'. The cover 31' is not fully sealed because the sealing O-ring surface 13' of the base 10' (the O-ring not being shown) is not in contact with the sealing surface 32' of the cover 30'. This temporary sealing is, however, sufficient to allow a momentary evacuation by a vacuum pump when a filter/dryer is being installed or for refrigerant recovery when the filter is being removed.

The refrigerant flow is shut-off with the configuration shown in FIG. 17 because the inlet 14' in the base 10' is covered by the threaded portion 21' of the valve assembly 20', and the refrigerant outlet port 15' is isolated by the bottom of the valve assembly 20' and the base 10'.

Figure 18:
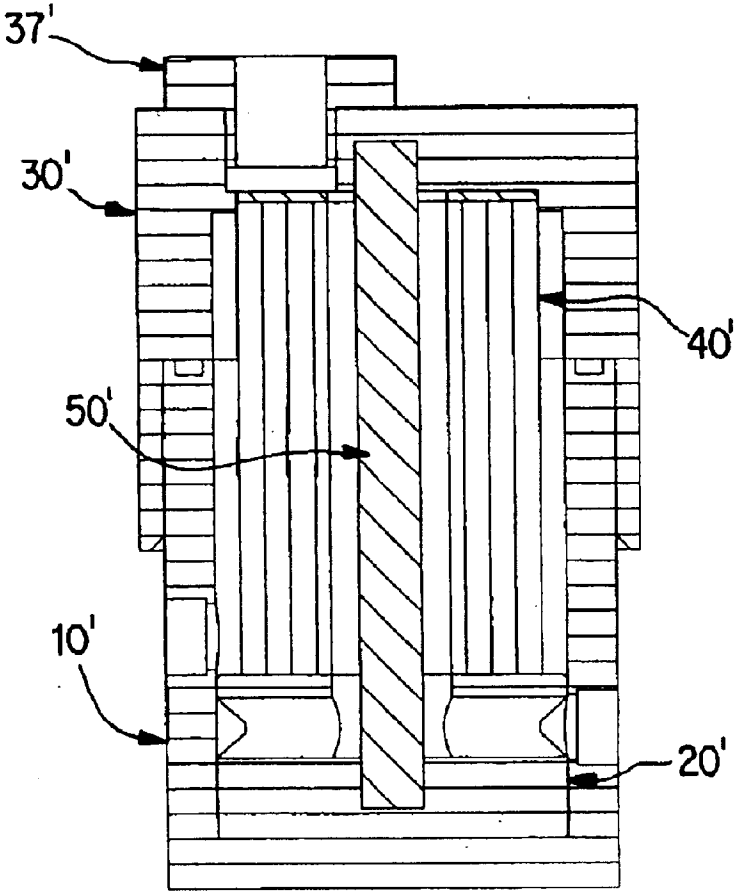
FIG. 18 is a cross-sectional view of the alternate configuration of the filter/dryer assembly with an optional sight-glass located in the filter/dryer cover, and with the moisture-indicating filter/dryer core in place.

FIG. 18, which is similar to FIG. 14, is a cross-sectional view of the filter/dryer assembly with an optional sight-glass 37' located in the filter/dryer cover 30', and with a previously described and shown moisture-indicating substance (not shown in FIG. 18) located on the filter/dryer core 40' and situated so as to be viewable through the sight-glass 37'.

Figure 19:
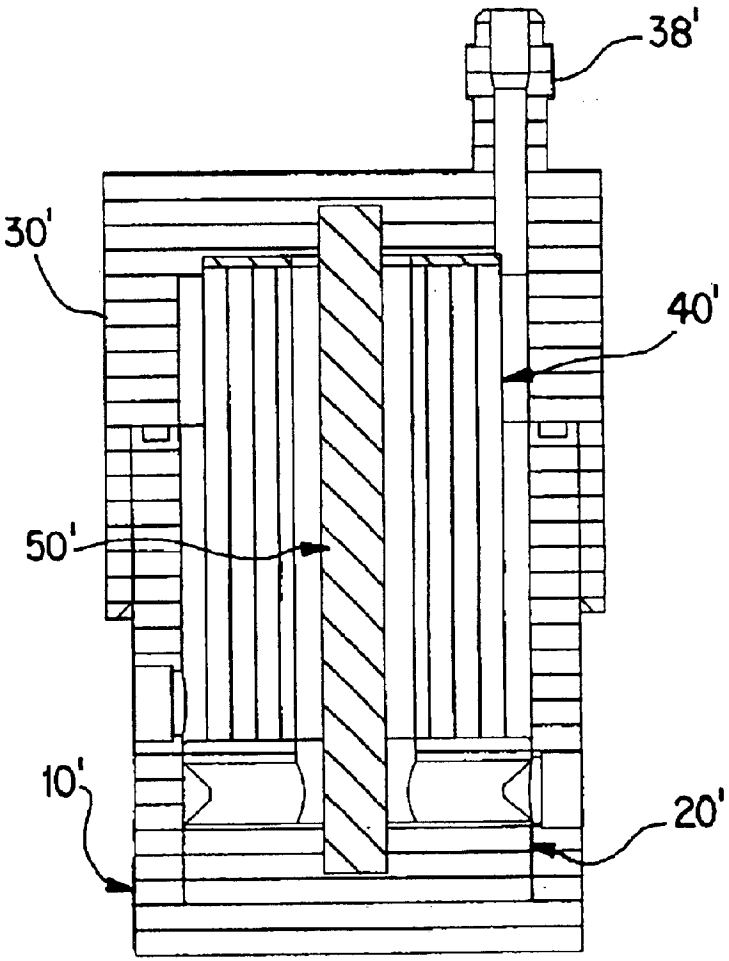
FIG. 19 is a cross-sectional view of the alternate configuration of the filter/dryer assembly with optional Schrader valve located in the filter/dryer cover.

FIG. 19, which is also similar to FIGS. 14 and 18, is a cross-sectional view of the filter/dryer assembly but with an optional Schrader valve 38' located in the filter/dryer cover 30' instead of a sight-glass.

Figure 20:
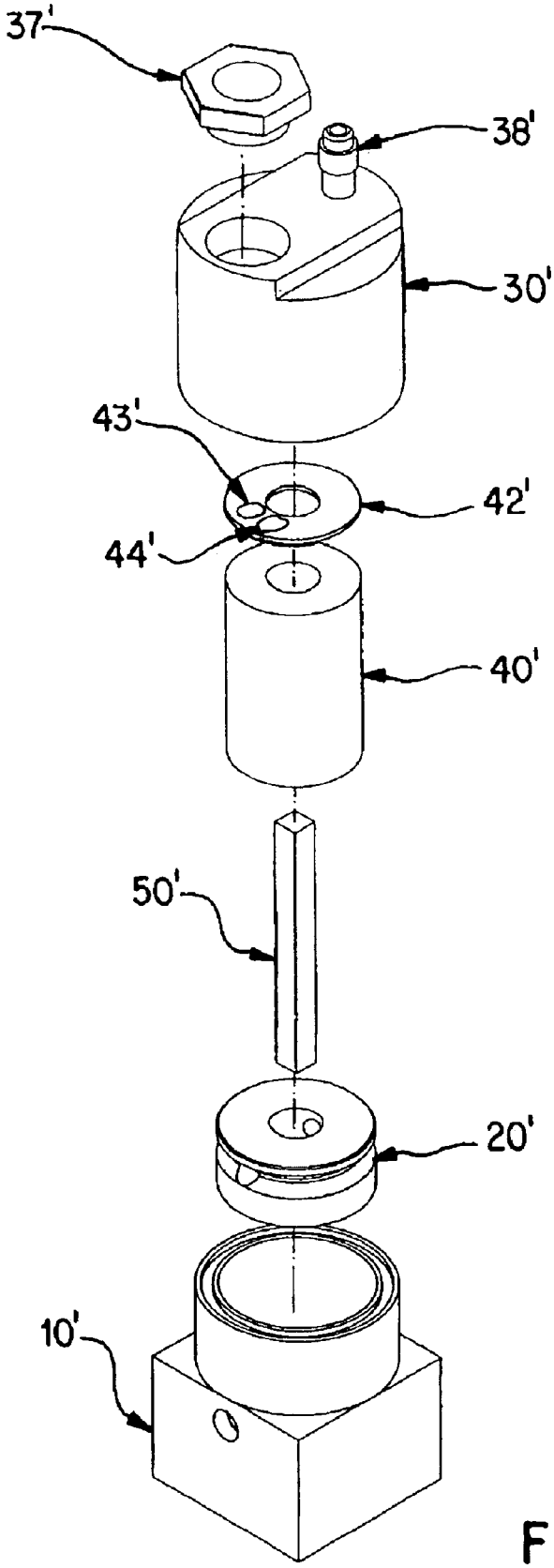
FIG. 20 is an exploded view of the filter/dryer assembly of FIGS. 18 and 19 containing the optional Schrader valve and sight-glass on the cover with the moisture-indicating substance on the filter/dryer core.

FIG. 20, which is similar to FIG. 13, is an exploded view of the filter/dryer assembly containing the optional Schrader valve 38' and sight-glass 37' on the cover as shown in FIGS. 18 and 19, as well as the moisture-indicating substance 43' and an acid-indicating substance 44' on the filter/dryer gasket 42'.

In one currently contemplated embodiment of the present invention the base is fabricated from a casting to reduce manufacturing costs. There are numerous methods for attaching refrigeration plumbing to the inlet an outlet, including, for example, threaded and flare fitting, brazing, soldering, etc. While soldering or brazing is the best way to assure leak free operation, it then requires the base to be fabricated from a material which can be easily field soldered or brazed using a flame torch. This increases the cost of materials, but lowers the machining operations required since precision threads or flare surfaces are not necessary. To avoid corrosion in the threaded surfaces resulting in thread binding and gauling the base, the valve spool assembly, and cover should be fabricated from similar materials or surface treated. The base can be either rectangular (square) or round: a round base used less material, whereas a square base is easier to fixture for machining.

It is also within the contemplation of the present invention to place an acid indicating substance in place of or in addition to the moisture-indicating substance on the filter/dryer core because either indicator would indicate when the capacity of the filter/dryer has been exhausted (since the filter/dryer moves both acid and water). These indicating substances can be deposited directly on the filter/dryer material, deposited on the outer surface of the filter/dryer, or fabricated into a pad and located on or near the filter/dryer core. These indicator substances must of course be within the viewing area of the sight-glass of the cover.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

We claim:

1. A filter-dryer apparatus, comprising:

a cover;

a base with an inlet into which a fluid is flowable and an outlet from which the fluid is exitable;

a filter configured to be associated interiorily of the base and cover so as to circulate the fluid from the inlet, through the filter and then to the outlet of the base;

means for removing the filter from the association with the cover, and single valve means for simultaneously isolating both the inlet and the outlet from the filter while providing a by-pass state which allows the fluid to flow from the inlet to the outlet without filtration.

2. The apparatus according to claim 1, wherein a sight-glass is arranged on the cover.

3. The apparatus according to claim 1, wherein a Schrader valve is arranged on the cover.

4. The apparatus according to claim 3, wherein a sight-glass is arranged on the cover.

5. The apparatus according to claim 1, wherein a sealing member is arranged between the filter and the cover.

6. The apparatus according to claim 5, wherein at least one of a moisture-indicator substance and an acid-indicator substance is arranged on the sealing member.

7. The apparatus according to claim 6, wherein a sight-glass is arranged on the cover so as to view the at least one of the moisture-indicator substance and the acid-indicator substance.

8. The apparatus according to claim 7, wherein a Schrader valve is arranged on the cover.

9. The apparatus according to claim 1, wherein a removable sealing cap is providable at one end of the base when the filter is altogether removed from the association with the cover and base.

10. The apparatus according to claim 9, wherein a second removable sealing cap is provided at another end of the base.

11. The apparatus according to claim 10, wherein the means for removing the filter is arranged to be accessible at the another end of the base upon removal of the second sealing cap.

12. The apparatus according to claim 1, wherein the filter is a porous-cylindrically-shaped core configured to fit inside the cover and has an interior channel through which the fluid flows from the inlet of the base to the outlet of the base.

13. A refrigerant cleaning assembly, comprising:

an internal valve spool assembly;

a base with an inlet and an outlet for operative connection with a vapor compression refrigeration, air conditioning or heat pump system;

a cover adapted to be attached to the base;

a core configured to be arranged inside the cover and to provide a path for at least one of filtering, drying and cleaning of fluid passing therethrough and a torque transmitting apparatus configured to transfer engaging motion of the cover to the internal valve spool assembly, wherein the internal valve spool assembly is configured to selectively direct fluid through the core, by-pass the core, and isolate the inlet and outlet, depending on a position thereof in the base.

14. The refrigerant cleaning assembly according to claim 13, wherein the cover and the internal valve spool assembly have mating machine threads for engagement therebetween.

15. The refrigerant cleaning assembly according to claim 13, wherein the core is configured as a hollow cylindrically-shaped member comprised of binder and one of desiccant material, adsorbent material and filtering material.

16. The refrigerant cleaning assembly according to claim 13, wherein the core is configured as a hollow cylindrically-shaped member comprised of one of loose filled desiccant, adsorbent and filtering materials, and includes an outside porous containment structure.

17. The refrigerant cleaning assembly according to claim 13, wherein the cover includes a threaded portion for attachment to the base.

18. The refrigerant cleaning assembly according to claim 17, wherein the cover comprises at least two flat surfaces for engagement with a wrench.

19. The refrigerant cleaning assembly according to claim 14, wherein the internal valve spool assembly comprises external threads configured to mate with internal threads at the base, whereby rotation of the internal valve provides the selective direction of the fluid flow through the core, by-pass the core, or isolates the inlet and outlet, depending on the position of the internal valve spool assembly in the base.

20. The refrigerant cleaning assembly according to claim 19, wherein the torque transmitting apparatus is configured as a hexagonal shaft adapted to mate with hexagonal sockets on the internal valve spool assembly and the cover.

21. The refrigerant cleaning assembly according to claim 13, wherein the core includes a moisture-indicating chemical medium associated with the core, and the cover has a sight glass to allow viewing of the medium.

22. The refrigerant cleaning assembly according to claim 21, wherein the moisture-indicating chemical medium is cobaltous chloride ($CoCl_2$).

23. The refrigerant cleaning assembly according to claim 21, wherein the moisture indicating chemical medium is cobaltous bromide ($CoBr_2$).

24. The refrigerant cleaning assembly according to claim 21, wherein the moisture indicating chemical medium is copper sulfate.

25. The refrigerant cleaning assembly according to claim 21, wherein the moisture indicating chemical medium is selected from a group consisting of alkali metal ozonides.

26. The refrigerant cleaning assembly according to claim 13, wherein the core includes an acid-indicating chemical medium, and the cover includes a sight glass to allow viewing of the medium.

27. The refrigerant cleaning assembly according to claim 26, wherein the acid-indicating chemical medium is pH paper.

28. The refrigerant cleaning assembly according to claim 13, wherein the cover includes a service port configured to allow the cover to be evacuated after engaging the base.

29. The refrigerant cleaning assembly according to claim 13, wherein the assembly is configured with a filtering chamber that is arranged to be automatically isolated from the inlet to the outlet of the bar upon removal of the core.

30. The refrigerant cleaning assembly according to claim 29, wherein the assembly has means for automatically connecting the inlet and the outlet of the base upon removal of the core.

31. The refrigerant cleaning assembly according to claim 13, wherein the assembly has means for automatically isolating the inlet and the outlet of the base upon removal of the core.

32. The refrigerant cleaning assembly according to claim 14, wherein the assembly is so configured that rotation of the cover to remove the core automatically rotates and translates the internal valve spool assembly so as to isolate a chamber in the assembly from the inlet and the outlet.

33. The refrigerant cleaning assembly according to claim 32, wherein external and internal threads on the base are so located so that rotation of the cover to engage the base provides for connection to the base prior to translation of the internal valve spool assembly sufficiently to connect the chamber to the inlet or the outlet, thereby causing the chamber to be isolated from both ambient and the system to which the assembly is connected, and allowing evacuation or recovery of the contents of a contained volume.

34. The refrigerant cleaning assembly according to claim 17, wherein an exterior surface of the cover includes means for allowing the assembly to be hand-tightened.

35. The refrigerant cleaning assembly according to claim 21, wherein the cover has a portion fitted with a color matching a color of the indicator chemical medium in the reacted or unreacted state.

36. The refrigerant cleaning assembly according to claim 26, wherein the cover is fitted with a color matching a color of the acid-indicating chemical medium in a reacted or an unreacted state.

37. A method for replacing a cleaning element for removing acid, moisture and other contaminates from an operating system, comprising rotating a filter/dryer cover relative to a base, positioning an inner valve spool assembly to isolate the cleaning element from flow of fluid and the system, and diverting the flow to the system which bypasses an area where the cleaning element was located.

38. The method according to claim 37, wherein the operating system is an air conditioner, heat pump or other vapor compression system and the cleaning element is a filter/dryer medium, further comprising using at least one of a moisture-indicating and acid-indicating substance in contact with the filter/dryer medium, and viewing a color of the substance through a sight glass.

* * * * *